US011323795B2

(12) United States Patent
Guo

(10) Patent No.: US 11,323,795 B2
(45) Date of Patent: May 3, 2022

(54) IN-EAR EARPHONE

(71) Applicant: SHENZHEN CANNICE TECHNOLOGY CO., LTD., Guangdong (CN)

(72) Inventor: Xiayun Guo, Guangdong (CN)

(73) Assignee: SHENZHEN CANNICE TECHNOLOGY CO., LTD, Guangdong (CN)

( * ) Notice: Subject to any disclaimer, the term of this patent is extended or adjusted under 35 U.S.C. 154(b) by 62 days.

(21) Appl. No.: 16/900,192

(22) Filed: Jun. 12, 2020

(65) Prior Publication Data

US 2021/0037305 A1 Feb. 4, 2021

(30) Foreign Application Priority Data

Jul. 30, 2019 (CN) ..... 201910695035.4

(51) Int. Cl.
*H04R 1/10* (2006.01)

(52) U.S. Cl.
CPC ..... *H04R 1/1016* (2013.01); *H04R 2460/11* (2013.01)

(58) Field of Classification Search
CPC .... H04R 1/1016; H04R 2460/11; H04R 1/10; H04R 25/652; H04R 1/1058; H04R 1/1083; H04R 1/1091; H04R 25/405; H04R 25/554; H04R 25/604
See application file for complete search history.

(56) References Cited

U.S. PATENT DOCUMENTS

2007/0071265 A1* 3/2007 Leedom ..... H04R 25/65 381/322
2012/0321103 A1* 12/2012 Smailagic ..... H04R 1/1041 381/98
2013/0343595 A1* 12/2013 Zorkendorfer ..... H04R 1/1016 381/380
2015/0382100 A1* 12/2015 Azmi ..... H04R 1/1091 381/380
2016/0212524 A1* 7/2016 Yuen ..... H04R 1/025
2019/0116437 A1* 4/2019 Bolsman ..... H04R 25/65

* cited by examiner

*Primary Examiner* — Alexander Krzystan
*Assistant Examiner* — Julie X Dang
(74) *Attorney, Agent, or Firm* — Yue (Robert) Xu; Apex Attorneys at Law, LLP

(57) ABSTRACT

An in-ear earphone includes a face shell for mounting an earphone cable and a bottom shell provided with an ear cap, and the face shell and the bottom shell are detachably fixed to each other. A loudspeaker and an air valve are arranged at the bottom shell, and the bottom shell is further provided with a sound transmission channel. One end of the sound transmission channel is in communication with an inner ear canal located at a side where the ear cap is located, and another end of the sound transmission channel is connected to a sealing plug formed by the air valve and the loudspeaker. One end of the air valve is connected to the sound transmission channel, and another end of the air valve is connected to an outer ear canal, to control the communication between the sound transmission channel and the outer ear canal.

6 Claims, 6 Drawing Sheets

IN-EAR EARPHONE

CROSS-REFERENCE TO RELATED APPLICATIONS

This application claims the priority to Chinese Patent Application No. 201910695035.4 titled "IN-EAR EARPHONE", filed with the China National Intellectual Property Administration on Jul. 30, 2019, which is incorporated herein by reference in its entirety.

FIELD

The present application relates to the technical field of earphones, and in particular to an in-ear earphone.

BACKGROUND

With the progress of the society and the improvement of science and technology, more and more people start to pay attention to improving the quality of life. For example, people start to enjoy or even get used to enjoying high-quality music at work or in sports. In this situation, there are many users listening to music with headsets, such as wired earphones, wireless earphones and the like, and the earphones have gradually become one of the most popular audio and video entertainment products for the public.

When the user is wearing a headset, such as an in-ear earphone, the product blocks the ear canals, thus forming a confined space with the auditory system, which blocks out the external sounds to a great extent. This kind of isolation reduces the experience of the natural external sounds of the user, leading to a very uncomfortable auditory feeling of confined space. Besides, safety problems may be caused due to lack of sound from the environment, such as the sounds of the approach of vehicles and pedestrians. In addition, a lot of noises caused by human activities, such as footsteps, can be transmitted to the ear canals through the human body, since the air in the ear canals is relatively isolated from the outside air, and there is no air channel for eliminating this kind of noise, the user may hear the very loud footsteps of their own, and this kind of noise is particularly evident during sports such as running, and the user experience is poor.

SUMMARY

In view of this, an object of the present application is to provide an in-ear earphone, to solve the problems of conventional earphones that the air in the ear canals is isolated from the outside air, and the user experience is adversely affected by the noises and the like.

In order to achieve the above object, a technical solution is provided according to the present application as follows.

An in-ear earphone includes a face shell for mounting an earphone cable and a bottom shell provided with an ear cap, and the face shell and the bottom shell are detachably fixed to each other. A loudspeaker and an air valve are arranged at the bottom shell, and the bottom shell is further provided with a sound transmission channel. One end of the sound transmission channel is in communication with an inner ear canal located at a side where the ear cap is located, and another end of the sound transmission channel is connected to a sealing plug formed by the air valve and the loudspeaker. One end of the air valve is connected to the sound transmission channel, and another end of the air valve is connected to an outer ear canal, to control the communication between the sound transmission channel and the outer ear canal.

Preferably, the bottom shell is provided with a mounting groove for mounting the air valve, and a sealing member is arranged between the mounting groove and the air valve.

Preferably, the sealing member is specifically a silicone sealing sleeve.

Preferably, the bottom shell or the face shell is provided with a vent at a position corresponding to the air valve, the vent is configured to be in communication with the outer ear canal, and the air valve is in communication with the outer ear canal through the vent.

Preferably, an outer side of the vent is covered with a mesh, and the mesh is detachably fixed to the bottom shell or the face shell.

Preferably, the vent is arranged on a side wall of the bottom shell, and an axis of the air valve is perpendicular to an axis of the loudspeaker.

Preferably, the vent is arranged on the face shell, and the axis of the air valve is parallel to the axis of the loudspeaker.

The in-ear earphone according to the present application includes the face shell for mounting the earphone cable and the bottom shell provided with the ear cap, and the face shell and the bottom shell are detachably fixed to each other. A loudspeaker and an air valve are arranged at the bottom shell, and the bottom shell is further provided with a sound transmission channel. One end of the sound transmission channel is in communication with an inner ear canal located at a side where the ear cap is located, and another end of the sound transmission channel is connected to a sealing plug formed by the air valve and the loudspeaker. One end of the air valve is connected to the sound transmission channel, and another end of the air valve is connected to an outer ear canal, to establish or block the communication between the sound transmission channel and the outer ear canal.

According to the in-ear earphone of the present application, the air valve is arranged at the bottom shell, one end of the sound transmission channel is in communication with the inner ear canal, and another end is connected to the sealing plug; one end of the air valve is connected to the sound transmission channel, and another end is connected to the outer ear canal; by controlling the opening and closing of the air valve, the communication between the inner ear canal and the outer ear canal is controlled to be established or blocked, thus the outer ear canal and the inner ear canal are allowed to be in communication with each other to realize air circulation according to the user's needs, which reduces noise and thereby improving the user experience.

BRIEF DESCRIPTION OF THE DRAWINGS

For more clearly illustrating embodiments of the present application or the technical solutions in the conventional technology, drawings referred to describe the embodiments or the conventional technology will be briefly described hereinafter. Apparently, the drawings in the following description are only some examples of the present application, and for those skilled in the art, other drawings may be obtained based on these drawings without any creative efforts.

Figure 1:
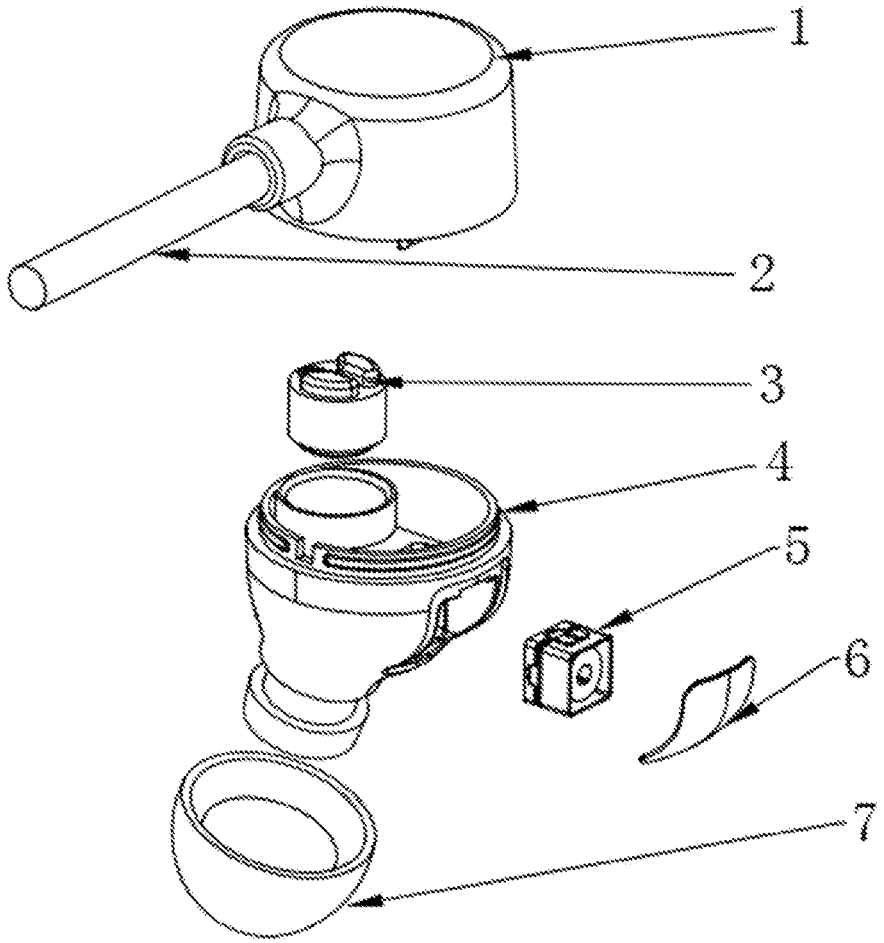
FIG. 1 is an exploded schematic view showing the structure of an in-ear earphone according to a first embodiment of the present application.
Figure 2A:
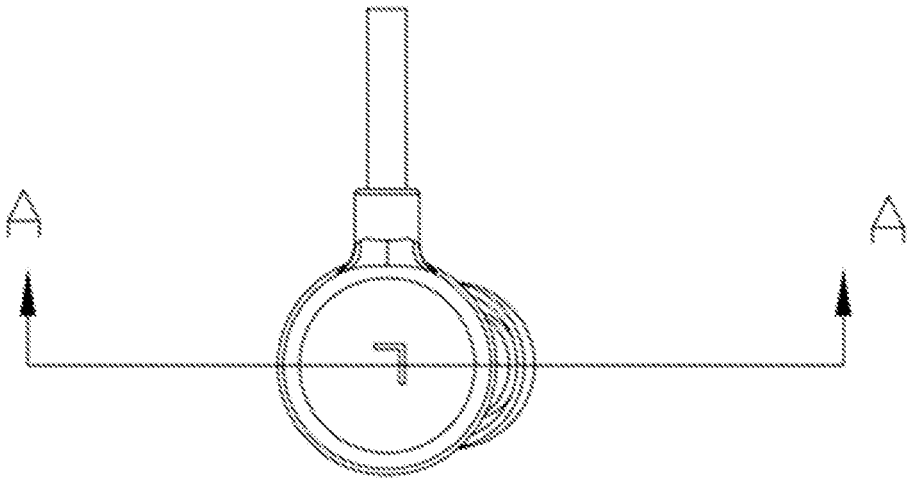
FIG. 2*a* is an overall structural view of FIG. 1.
Figure 2B:
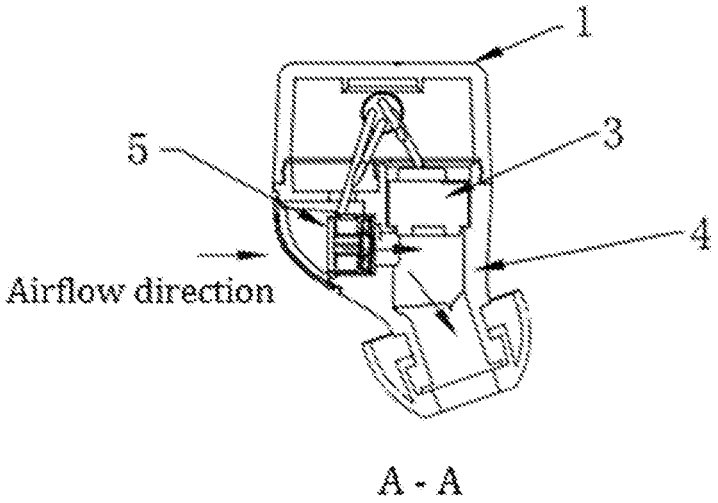
FIG. 2*b* is a sectional view showing the structure of the in-ear earphone taken in a direction A-A in FIG. 2*a;*

| Reference Numerals: | | | |
|---|---|---|---|
| 1 | face shell, | 2 | earphone cable, |
| 3 | loudspeaker, | 4 | bottom shell, |
| 5 | air valve, | 6 | mesh, |
| 7 | ear cap, | 8 | silicone sealing sleeve, |
| 9 | mounting groove. | | |

DETAILED DESCRIPTION OF THE EMBODIMENTS

An in-ear earphone is provided according to embodiments of the present application, to solve the problems of conventional earphones that the air in ear canals is isolated from the outside air, and the user experience is adversely affected by the noises and the like.

The technical solution according to the embodiments of the present application will be described clearly and completely as follows in conjunction with the accompany drawings in the embodiments of the present application. It is obvious that the described embodiments are only a part of the embodiments according to the present application, rather than all of the embodiments. All the other embodiments obtained by those skilled in the art based on the embodiments in the present application without any creative work belong to the scope of protection of the present application.

Figure 3:
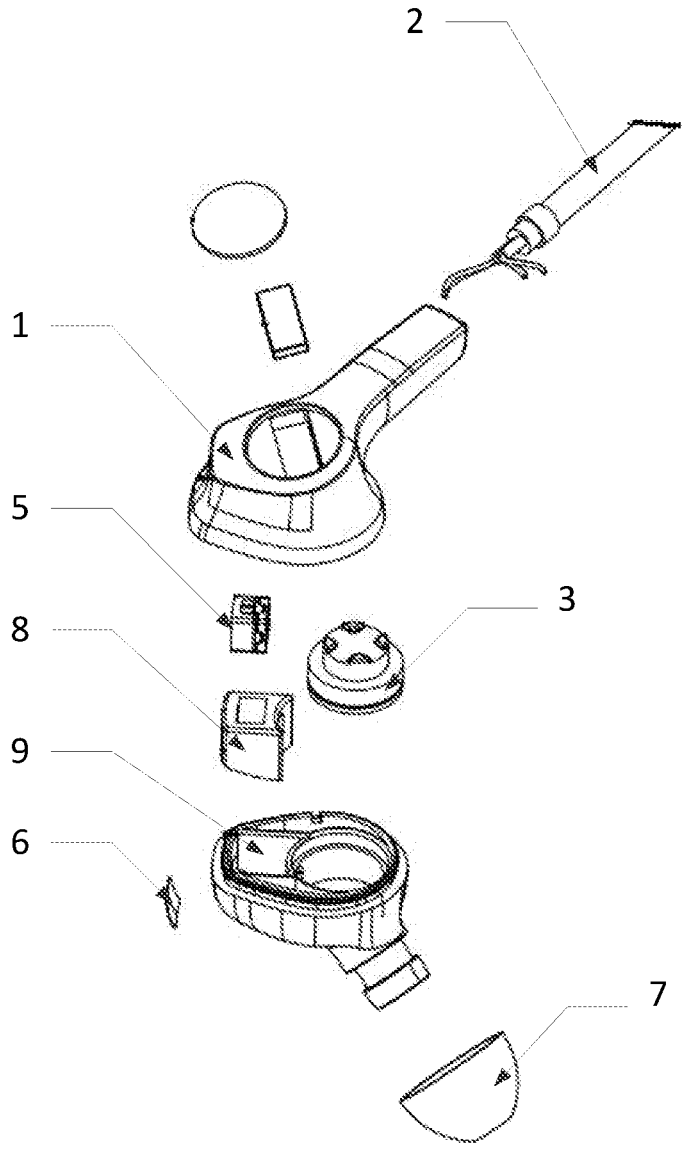
FIG. 3 is an exploded schematic view showing the structure of an in-ear earphone according to a second embodiment of the present application.
Figure 4A:
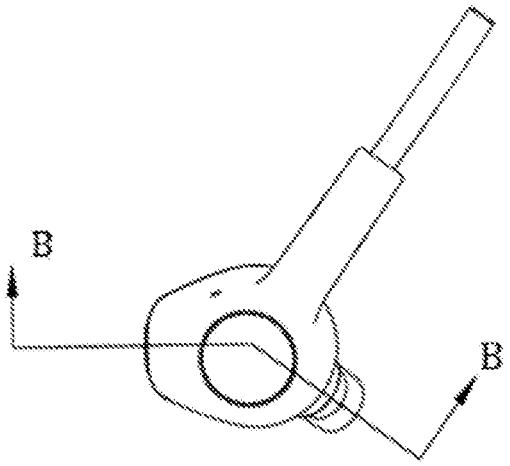
FIG. 4*a* is an overall structural view of FIG. 3.
Figure 4B:
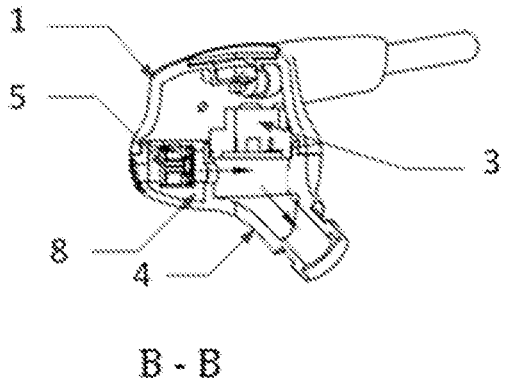
FIG. 4*b* is a sectional view showing the structure of the in-ear earphone taken in a direction B-B in FIG. 4*a;*
Figure 5:
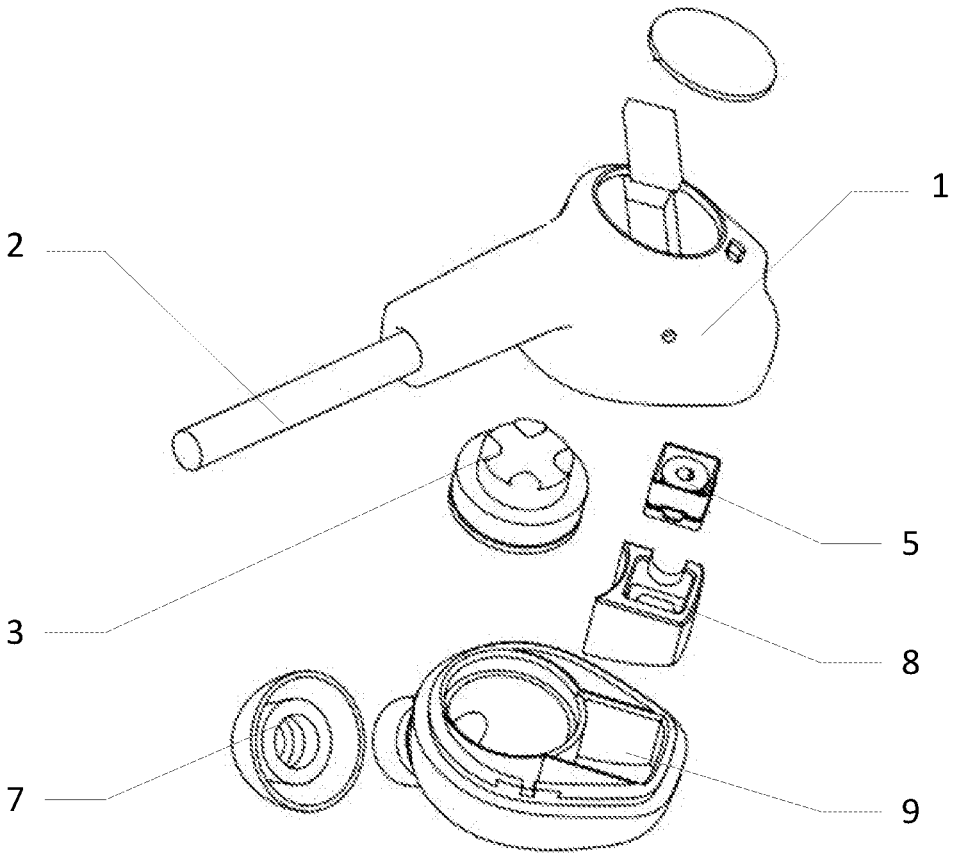
FIG. 5 is an exploded schematic view showing the structure of an in-ear earphone according to a third embodiment of the present application.
Figure 6A:
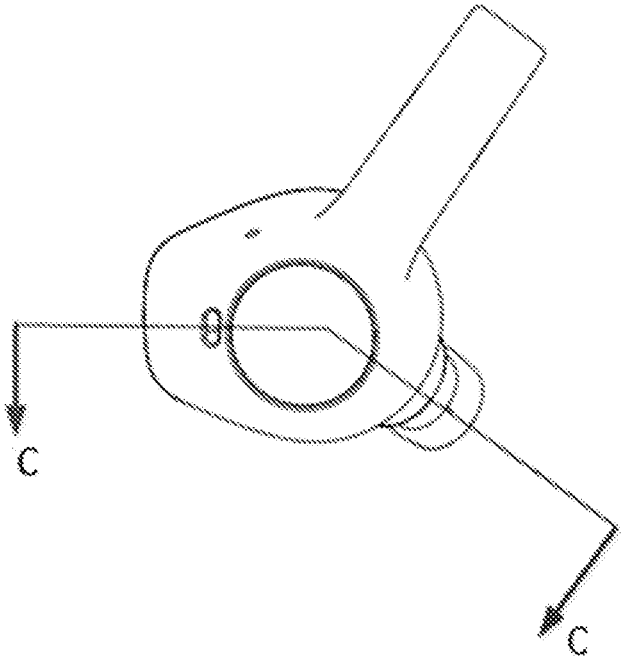
FIG. 6*a* is an overall structural view of FIG. 5.
Figure 6B:
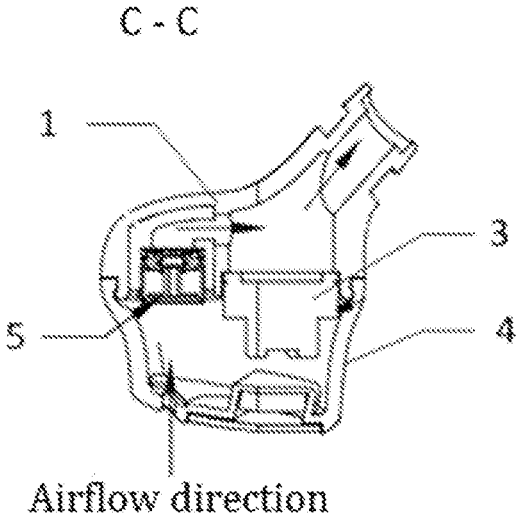
FIG. 6*b* is a sectional view showing the structure of the in-ear earphone taken in a direction C-C in FIG. 6*a*.

Reference is made to FIGS. 1 to 6, FIG. 1 is an exploded schematic view showing the structure of an in-ear earphone according to a first embodiment of the present application; FIG. 2*a* is an overall structural view of FIG. 1; FIG. 2*b* is a sectional view showing the structure of the in-ear earphone taken in a direction A-A in FIG. 2*a*; FIG. 3 is an exploded schematic view showing the structure of an in-ear earphone according to a second embodiment of the present application; FIG. 4*a* is an overall structural view of FIG. 3; FIG. 4*b* is a sectional view showing the structure of the in-ear earphone taken in a direction B-B in FIG. 4*a*; FIG. 5 is an exploded schematic view showing the structure of an in-ear earphone according to a third embodiment of the present application; FIG. 6*a* is an overall structural view of FIG. 5; and FIG. 6*b* is a sectional view showing the structure of the in-ear earphone taken in a direction C-C in FIG. 6*a*.

In a specific embodiment, an in-ear earphone according to the present application includes a face shell 1 for mounting an earphone cable 2 and a bottom shell 4 provided with an ear cap 7, and the face shell 1 and the bottom shell 4 are detachably fixed to each other. A loudspeaker 3 and an air valve 5 are arranged at the bottom shell 4, and the bottom shell 4 is further provided with a sound transmission channel. One end of the sound transmission channel is in communication with an inner ear canal located at a side where the ear cap 7 is located, and another end of the sound transmission channel is connected to a sealing plug formed by the air valve 5 and the loudspeaker 3. One end of the air valve 5 is connected to the sound transmission channel, and another end of the air valve 5 is connected to an outer ear canal, to establish or block the communication between the sound transmission channel and the outer ear canal.

It can be understood that, the air valve 5 is a conventional device, which may use micro magnetic valve to realize opening or closing of a channel. The air valve 5 may be connected to a control circuit through the earphone cable 2, the loudspeaker 3 can also be connected to the control circuit through the earphone cable 2, and the specific connection relationship may refer to the conventional technology. The face shell 1 and the bottom shell 4 may be fixed to each other by means of clamping or threaded connection. The loudspeaker 3 and the air valve 5 are arranged at the bottom shell 4, and the bottom shell 4 is further provided with a sound transmission channel. The sealing plug formed by the loudspeaker 3 and the air valve 5 isolates the sound transmission channel from the outer ear canal. It can be understood that, sealing devices are respectively arranged between the loudspeaker 3 and the bottom shell 4 and between the air valve 5 and the bottom shell 4, to realize sealing. One end of the sound transmission channel is in communication with the inner ear canal through the ear cap 7, and a sound amplifying portion of the loudspeaker 3 is connected to the sound transmission channel, to effectively transmit the sound. The air valve 5 is connected to the control circuit, to control the opening and closing of the air valve 5. In one embodiment, in a case that a positive voltage level is provided to the air valve 5, the air valve 5 is opened to form an air circulation channel with the outside. When a negative voltage level is provided to the air valve 5, the air valve 5 is closed, to close the air circulation channel.

According to the in-ear earphone of the present application, the air valve 5 is arranged at the bottom shell 4, one end of the sound transmission channel is in communication with the inner ear canal, and another end of the sound transmission channel is connected to the sealing plug; one end of the air valve 5 is connected to the sound transmission channel, and another end the air valve 5 is connected to the outer ear canal. By controlling the opening and closing of the air valve, the communication between the inner ear canal and the outer ear canal is controlled to be established or blocked, thus the outer ear canal and the inner ear canal are allowed to be in communication with each other to realize air circulation according to the user's needs, which reduces noise and thereby improving the user experience.

Specifically, a mounting groove 9 for mounting the air valve 5 is arranged at the bottom shell 4, and a sealing member is arranged between the mounting groove 9 and the air valve 5. Similarly, a loudspeaker mounting groove for mounting the loudspeaker 3 is arranged at the bottom shell 4, the mounting groove 9 is preferably arranged near a circumferential direction of the loudspeaker mounting groove. The sealing member is arranged in the mounting groove 9, preferably, the sealing member is fixed to the mounting groove 9 by bonding. The air valve 5 is connected to the mounting groove 9 through the sealing member, the sealing member is preferably a silicone sealing sleeve 8, which is simple in structure and convenient for disassembly and assembly, and has good sealing performance. In other embodiments, the sealing members may also be selected as required, all of which are within the scope of protection of the present application.

In one embodiment, the bottom shell 4 or the face shell 1 is provided with a vent at a position corresponding to the air valve 5, the vent is configured to be in communication with the outer ear canal, and the air valve 5 is in communication with the outer ear canal through the vent. A solution in which the bottom shell 4 is provided with the vent is described herein, and the vent runs through the bottom shell 4 to realize the communication with the outer ear canal (the outside). Preferably, the air valve 5 is arranged opposite to the vent, so as to facilitate the air circulation. Preferably, the number of the vent is one, in a case that the air valve 5 is opened, the vent, the air valve 5 and an air path where the sound transmission channel is located are in communication, and the airflow can flow in two directions. Further, a mesh 6 is covered on an outer side of the vent, and the mesh 6 is detachably fixed to the bottom shell 4 or the face shell 1. With this arrangement, dust or sundries are prevented from entering into the earphone through the vent. The mesh 6 may be arranged at the bottom shell 4 by clamping or bonding, and can also be arranged according to actual needs, all of which are within the scope of protection of the present application. In other embodiments, both the vent and the mesh 6 may be arranged on the face shell 1, to optimize a mounting space.

In one embodiment, the vent is arranged at a side wall of the bottom shell 4, and an axis of the air valve 5 is arranged perpendicular to an axis of the loudspeaker 3. In this way, the mounting space is saved, a size of the earphone can be reduced, and thus the delicate arrangement is realized. In a case that the mounting groove 9 is arranged in a direction that an opening of the bottom shell 4 faces, the air valve 5 can be mounted into the mounting groove 9 from top to bottom to realize fixation, and the vent and the mesh 6 may be arranged at the circumferential side wall of the bottom shell 4. Alternatively, in another embodiment, the mounting groove 9 is arranged in a direction perpendicular to the direction that the opening of the bottom shell 4 faces, that is, the mounting groove 9 is arranged at the circumferential side wall of the bottom shell 4, and the air valve 5 may be laterally pushed into the mounting groove 9. In this case, the vent and the mounting groove 9 are arranged at a same position, after the air valve 5 has been mounted, the mesh 6 may be provided at an outer side of the mounting groove 9, so as to limit the air valve 5, and thus optimizing an internal space of the earphone.

Alternatively, in another embodiment, in a case that the mounting space is sufficient, the vent may be arranged at the face shell 1, and the axis of the air valve 5 is in parallel with the axis of the loudspeaker 3. The airflow enters into the earphone through the face shell 1, and then flows to the sound transmission channel through the air valve 5. It can be seen that the airflow can flow in two directions. Such arrangement facilitates the sealing between the sound transmission channel and the sealing plug formed by the air valve 5 and the loudspeaker 3, and the mounting is also convenient.

It can be seen from the above that, the air path formed by the sound transmission channel, the outer ear canal and the inner ear canal is bidirectional, and the airflow can flow from outside to inside or from inside to outside. The opening and closing of the air valve 5 may be realized by manual or automatic control. In a case that the manual control is employed, the user can open or close the air valve 5 through the control device by himself. In a case that the automatic control is employed, an ambient decibel value may be detected a detection device, such as a decibel detector. The ambient decibel value is compared with a preset value by the control device, in a case that the ambient decibel value is greater than or equal to the preset value, it indicates that the user is in an outdoor space, and the air valve 5 may be opened to allow the air inside the earphone to be in communication with the outside air, so as to improve the safety. It is only a preferred embodiment described herein, and the control mode of the air valve 5 may be arranged according to actual needs.

It should be noted that, the terms "first", "second" and the like in the present application are used for distinguishing between similar parts and are not intended to describe or imply a specific sequence or precedence order. Furthermore, terms "include", "comprise" or any other variations are intended to cover non-exclusive "include", thus a process, a method, an object or a device including a series of factors not only include the listed factors, but also include other factors not explicitly listed, or also include inherent factors of the process, the method, the object or the device. Without more limitations, a factor defined by a sentence "include one . . . " does not exclude a case that there is another same factor in the process, the method, the object or the device including the described factor.

The above embodiments in this specification are described in a progressive manner. Each of the embodiments is mainly focused on describing its differences from other embodiments, and references may be made among these embodiments with respect to the same or similar portions among these embodiments.

Based on the above description of the disclosed embodiments, those skilled in the art are capable of carrying out or using the present application. It is obvious for those skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The invention claimed is:

1. An in-ear earphone, comprising:

a face shell configured for mounting an earphone cable; and a bottom shell provided with an ear cap; wherein the face shell and the bottom shell are detachably fixed to each other;

a loudspeaker and an air valve are arranged at the bottom shell, the bottom shell is further provided with a sound transmission channel, one end of the sound transmission channel is configured to be in communication with an inner ear canal located at a side where the ear cap is located, and another end of the sound transmission channel is connected to a sealing plug formed by the air valve and the loudspeaker; and one end of the air valve is connected to the sound transmission channel, and another end of the air valve is connected to an outer ear canal, to control the communication between the sound transmission channel and the outer ear canal, wherein the bottom shell or the face shell is provided with a vent at a position corresponding to the air valve, the vent is configured to be in communication with the outer ear canal, and the air valve is in communication with the outer ear canal through the vent.

2. The in-ear earphone according to claim 1, wherein the bottom shell is provided with a mounting groove for mounting the air valve, and a sealing member is arranged between the mounting groove and the air valve.

3. The in-ear earphone according to claim 2, wherein the sealing member is a silicone sealing sleeve.

4. The in-ear earphone according to claim 1, wherein an outer side of the vent is covered with a mesh, and the mesh is detachably fixed to the bottom shell or the face shell.

5. The in-ear earphone according to claim 4, wherein the vent is arranged on a side wall of the bottom shell, and an axis of the air valve is perpendicular to an axis of the loudspeaker.

6. The in-ear earphone according to claim 4, wherein the vent is arranged on the face shell, and an axis of the air valve is parallel to an axis of the loudspeaker.

* * * * *